US007859492B2

(12) United States Patent
Kohno

(10) Patent No.: US 7,859,492 B2
(45) Date of Patent: Dec. 28, 2010

(54) ASSURING UNIFORMITY IN THE OUTPUT OF AN OLED

(75) Inventor: Makoto Kohno, Kanagawa (JP)

(73) Assignee: Global OLED Technology LLC, Herndon, VA (US)

( * ) Notice: Subject to any disclaimer, the term of this patent is extended or adjusted under 35 U.S.C. 154(b) by 708 days.

(21) Appl. No.: 11/422,752

(22) Filed: Jun. 7, 2006

(65) Prior Publication Data

US 2006/0284802 A1 Dec. 21, 2006

(30) Foreign Application Priority Data

Jun. 15, 2005 (JP) ..... 2005-175745

(51) Int. Cl.
*G09G 3/30* (2006.01)

(52) U.S. Cl. ..... 345/77

(58) Field of Classification Search ..... 345/76–83, 345/55, 204; 315/169.3
See application file for complete search history.

(56) References Cited

U.S. PATENT DOCUMENTS 6,873,117 B2 * 3/2005 Ishizuka ..... 315/169.1
7,245,277 B2 * 7/2007 Ishizuka ..... 345/78
7,280,705 B1 * 10/2007 Frank et al. ..... 382/274
2003/0016198 A1 * 1/2003 Nagai et al. ..... 345/83
2003/0210256 A1 * 11/2003 Mori et al. ..... 345/690
2004/0150592 A1 8/2004 Mizukoshi et al.
2004/0263442 A1 * 12/2004 Shingai et al. ..... 345/76
2005/0110420 A1 * 5/2005 Arnold et al. ..... 315/169.3

FOREIGN PATENT DOCUMENTS

JP 11-282420 10/1999

* cited by examiner

*Primary Examiner*—Amr Awad
*Assistant Examiner*—Kenneth Bukowski
(74) *Attorney, Agent, or Firm*—Morgan Lewis & Bockius LLP

(57) ABSTRACT

A display area of a display panel is divided into a plurality of areas, and a current detector detects a driving current (i.e. CV current) that flows when light is emitted from an area or a block including a plurality of areas. Such current detection is repeated while sequentially changing the target area or block and a CPU detects an area that has a current value different from that of other areas (i.e. an area that requires correction) based on results of the results of current detection. A similar process is performed on smaller areas obtained by subdividing the area to find a smaller area that requires correction. Thus, a correction value is obtained for each pixel and the correction values are efficiently calculated.

11 Claims, 18 Drawing Sheets

| | | | | |
|---|---|---|---|---|
| | $\frac{-1}{2}$ | -1 | $\frac{-1}{2}$ | |
| $\frac{-1}{2}$ | 0 | 1 | 0 | $\frac{-1}{2}$ |
| -1 | 1 | 4 | 1 | -1 |
| $\frac{-1}{2}$ | 0 | 1 | 0 | $\frac{-1}{2}$ |
| | $\frac{-1}{2}$ | -1 | $\frac{-1}{2}$ | |

FIG. 7C

| | | | | |
|---|---|---|---|---|
| -1 | -1 | | -1 | -1 |
| -1 | 0 | 2 | 0 | -1 |
| | 2 | 4 | 2 | |
| -1 | 0 | 2 | 0 | -1 |
| -1 | -1 | | -1 | -1 |

FIG. 8C

: 8X8 PIXEL ARE HAVING NONUNIFORMITY

: PIXELS TO BE ACTIVATED TO OBTAIN AVERAGED PERIPHERAL TFT CHARACTERISTICS

ASSURING UNIFORMITY IN THE OUTPUT OF AN OLED

FIELD OF THE INVENTION

The present invention generally relates to a correction performed for assuring uniformity in the display of an organic EL display device that includes numerous organic EL elements arranged in a matrix pattern.

BACKGROUND OF THE INVENTION

Conventional organic EL (OLED) display devices including a plurality of organic EL (OLED) elements arranged in a matrix pattern are well known. Among these, attention is especially focused on active-matrix OLED display devices which are expected to become widely used in thin-type display devices. In active-matrix OLED display devices, transistors are provided for respective pixels to control a driving current supplied to each OLED element.

FIG. 1 shows an example of a circuit arrangement for a pixel of a conventional active-matrix OLED display device. In this arrangement, a p-channel TFT (i.e. thin film transistor) 1, used for driving a pixel, has a source connected to a power source PVdd and a drain connected to an anode of an OLED (i.e. organic EL) element 3. A cathode of OLED element 3 is connected to a negative power source CV.

TFT 1 has a gate connected via an auxiliary capacitance C to the power source PVdd on one hand and is connected via an n-channel TFT 2, used for selection, to a data line Data on the other hand. A voltage signal based on pixel data (luminance data) is supplied to the data line Data. TFT 2 has a gate connected to a gate line Gate extending in a horizontal direction.

During display, the gate line Gate is kept at an H level to turn on TFT 2 of a corresponding line. Under this condition, pixel data (i.e. input voltage based on pixel data) is supplied to the data line Data and is stored as electric charge in the auxiliary capacitance C. Thus, the voltage corresponding to the pixel data brings TFT 1 into operation. The current of TFT 1 flows across the OLED element 3.

The light emitted from OLED element 3 is substantially proportional to the current flowing in OLED element 3. In TFT 1, the current begins to flow when a potential difference Vgs, representing a potential difference between the gate of TFT 1 and the power source PVdd, exceeds a predetermined threshold voltage Vth. In view of the above, the pixel data supplied to the data line Data includes a previously included voltage (Vth) which allows the drain current to start flowing at around a black level of the image. Furthermore, the amplitude of an image signal is set to an appropriate value so that a predetermined luminance can be obtained at around a white level.

FIG. 2 shows an example relationship between input voltage (Vgs), luminance of OLED element 3, and current icv flowing in this element (i.e. V-I characteristics). As is apparent from this relationship, the OLED element 3 starts emitting light when the input voltage Vgs reaches the voltage Vth. A predetermined luminance is attained at the input voltage of a white level.

The OLED display device has a display panel including numerous pixels arranged in a matrix pattern. With such a configuration, there is a possibility that, the threshold voltage Vth and the inclination of the V-I characteristics of respective pixels may vary due to manufacturing errors. The light emission from a pixel relative to a data signal (i.e. input voltage) may be different in each pixel, and accordingly this is generally recognized as nonuniformity in the luminance. FIGS. 3A and 3B show differences between two pixels m and n that occur when there is a variation in the threshold voltage Vth or in the inclination of the V-I characteristics. FIG. 3C shows composite differences of two pixels m and n resulting from variations in both the threshold voltage Vth and the inclination of the V-I characteristics. In this manner, when a difference ΔVth in the threshold voltage Vth appears between two pixels, the curve of V-I characteristics shifts by the same amount ΔVth. Furthermore, when the inclination of the V-I characteristics varies between two pixels, their V-I characteristics form the curves different in the inclination from each other. Such a difference in the threshold voltage Vth or in the inclination of the V-I characteristics may occur locally on the display screen.

Therefore, it has been proposed to measure the luminance of each pixel and perform correction for all pixels or only defective pixels based on correction data stored in a memory (refer to Japanese Patent Application Laid-open No. 11-282420, for example)

Furthermore, a technique of dividing the display area into smaller dissected areas and measuring current values in respective areas to obtain an overall tendency, thereby calculating a coefficient for correction of the overall display or of an individual area is also known (refer to U.S. Patent Application Publication 2004/0150592, for example).

However, with the former technique, it is generally difficult to accurately accomplish, within a short time, the measurement of the luminance for numerous pixels, while, with the latter technique, the correctable differences or nonuniformity is limited to the pixels having luminance values continuously changing along the entire display area or pixels having a specific pattern in the vertical or horizontal line.

SUMMARY OF THE INVENTION

In view of the problems described above, the present invention efficiently detects non-uniformity in an organic EL display device, calculates correction values, and performs correction.

The present invention provides a method for making an organic EL display device, wherein the organic EL display device is formed by arranging a plurality of display pixels in a matrix pattern, each display pixel including an organic EL element. This method includes a dividing step, a detecting step, a calculating step, and a storing step. In the dividing step, a display area is divided into a plurality of predetermined detection areas to selectively cause organic EL elements of a plurality of display pixels in the detection areas to emit light to detect a driving current for each detection area. The detecting step is performed, based on driving current values detected for respective detection areas, to detect a detection area that has a luminance value different from that of other detection areas and requires correction. The calculating step is provided for calculating correction data required for correcting image data for each pixel that is input to the detection area that requires correction. And, in the storing step, a memory stores the position of a pixel that requires correction and correction data calculated for this pixel.

Furthermore, according to the method of this invention, it is preferable that the detection area that requires correction is subdivided into a plurality of smaller detection areas. The processing for detecting a smaller detection area that requires correction is performed once or sequentially at least twice on the smaller detection areas. An objective detection area is obtained as an object that requires calculation of correction data.

Furthermore, according to the method of this invention, it is preferable that the objective detection area, obtained as the object that requires calculation of correction data, is one display pixel or one dot in a display.

Furthermore, according to the method of this invention, it is preferable that with respect to current values detected from the divided detection areas of the display area, a plurality of predetermined detection areas including the objective detection area is processed by multiplying a two-dimensional space filter with the detect currents, and an objective detection area that requires correction is obtained based on the result of the processing.

Furthermore, according to the method of this invention, it is preferable that detection of the driving current in each detection area is performed by sequentially changing a target position and simultaneously activating a plurality of detection areas, and the two-dimensional space filter is calculated based on the detected results.

Furthermore, according to the method of this invention, it is preferable that the two-dimensional space filter has coefficients of respective detection areas, so as to give a large weighting factor to the objective detection area, add a value of a peripheral detection area positioned closely to the objective detection area, and subtract a value of a peripheral detection area positioned far from the objective detection area.

Furthermore, with respect to the detection area that requires correction, it is possible to repeat the similar process on further divided areas to narrow the detection to a smaller detection area that requires correction. This reduces both the number of measurements and amount of time required.

The above and other objects, features and advantages of the present invention will become more apparent from the following detailed description of exemplary embodiments and reference to the attached drawings

BRIEF DESCRIPTION OF THE DRAWINGS

The accompanying drawings, which are incorporated in and constitute a part of the specification, illustrate an embodiment of the invention and, together with the description, serve to explain the principles of the invention. In the accompanying drawings:

FIG. 7C is a diagram showing the arrangement of a filter;

FIG. 8C is a diagram showing the arrangement of a filter;

DESCRIPTION OF PREFERRED EMBODIMENT

Hereinafter, a preferred embodiment of the present invention will be explained with reference to the attached drawings.

Figure 1:
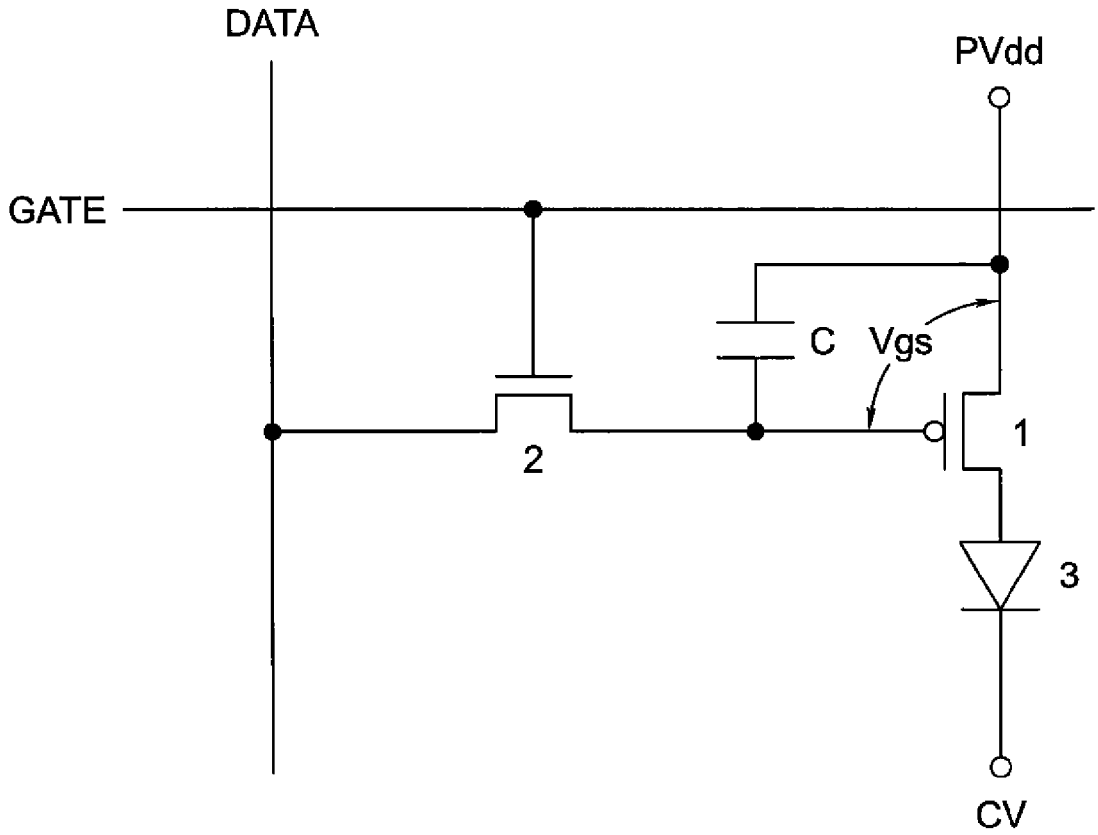
FIG. 1 PRIOR ART
FIG. 1 is a circuit diagram showing the arrangement of a prior art pixel circuit.
Figure 2:
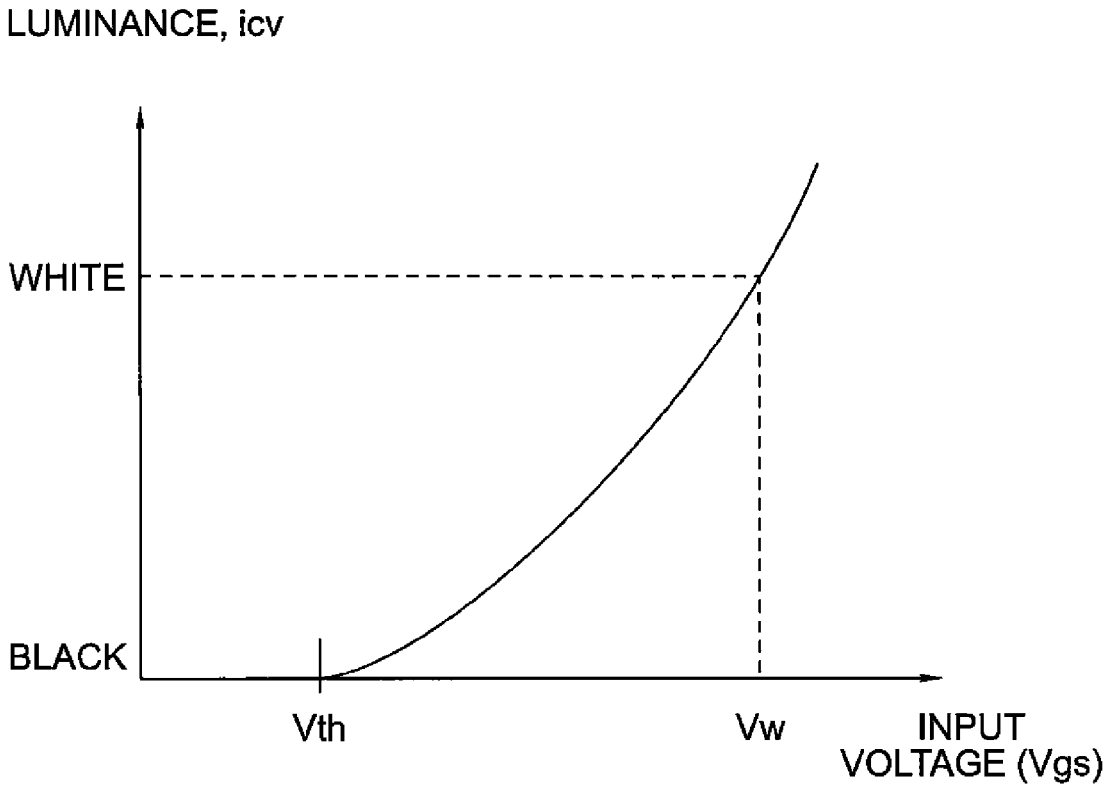
FIG. 2 is a graph showing a relationship between an input voltage, luminance, and driving current icv.
Figure 3A:
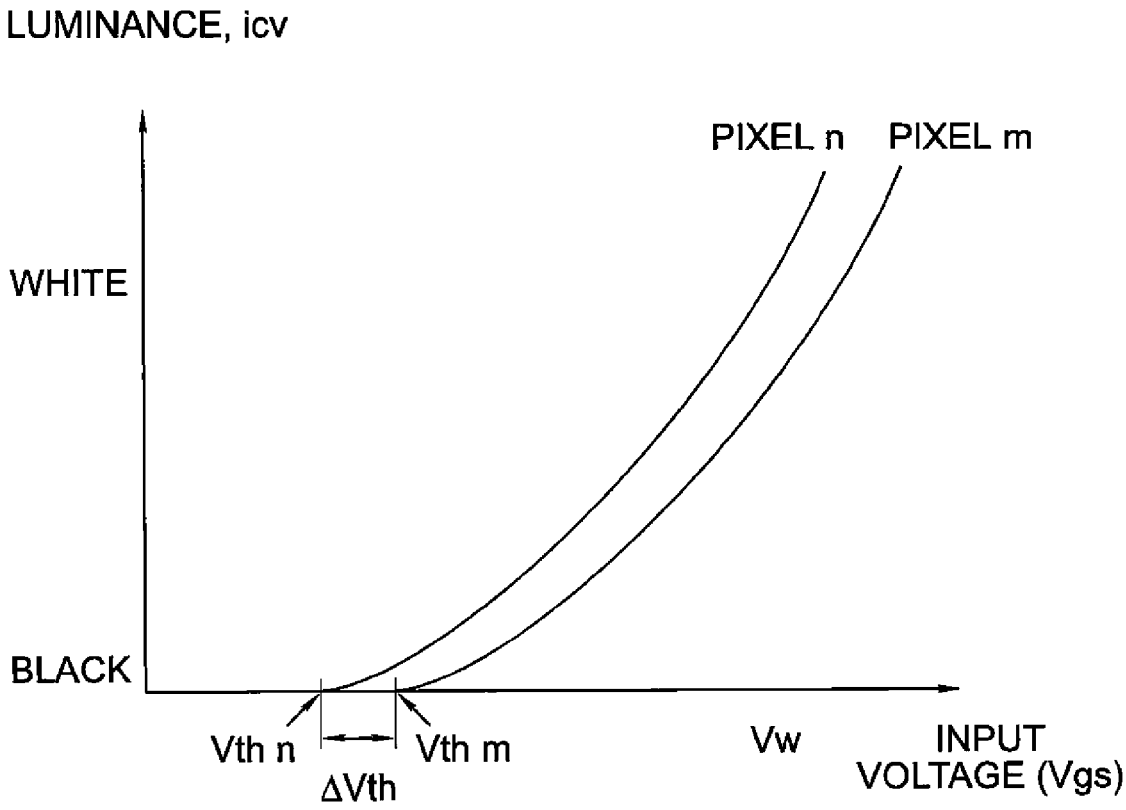
FIG. 3A is a graph showing a relationship between the input voltage, luminance, and driving current icv observed when a variation occurs in a threshold voltage Vth.
Figure 3B:
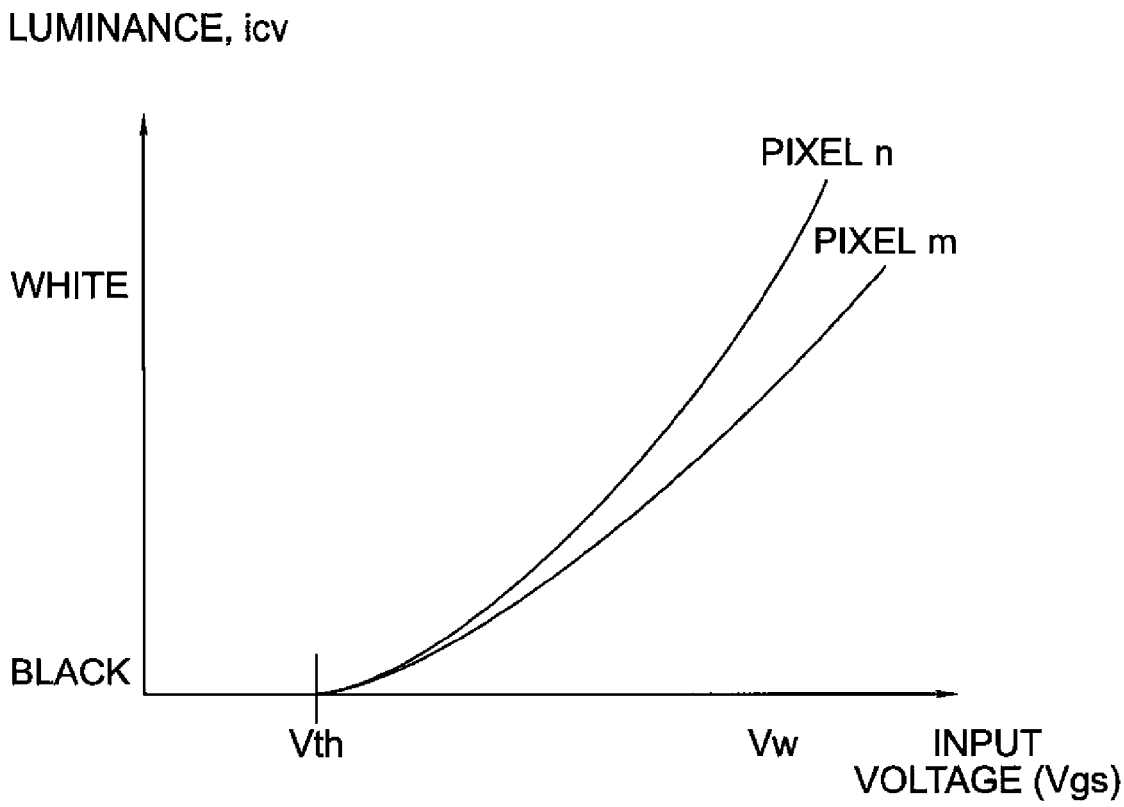
FIG. 3B is a graph showing a relationship between the input voltage, luminance, and driving current icv observed when a variation occurs in the inclination of the V-I characteristics.
Figure 3C:
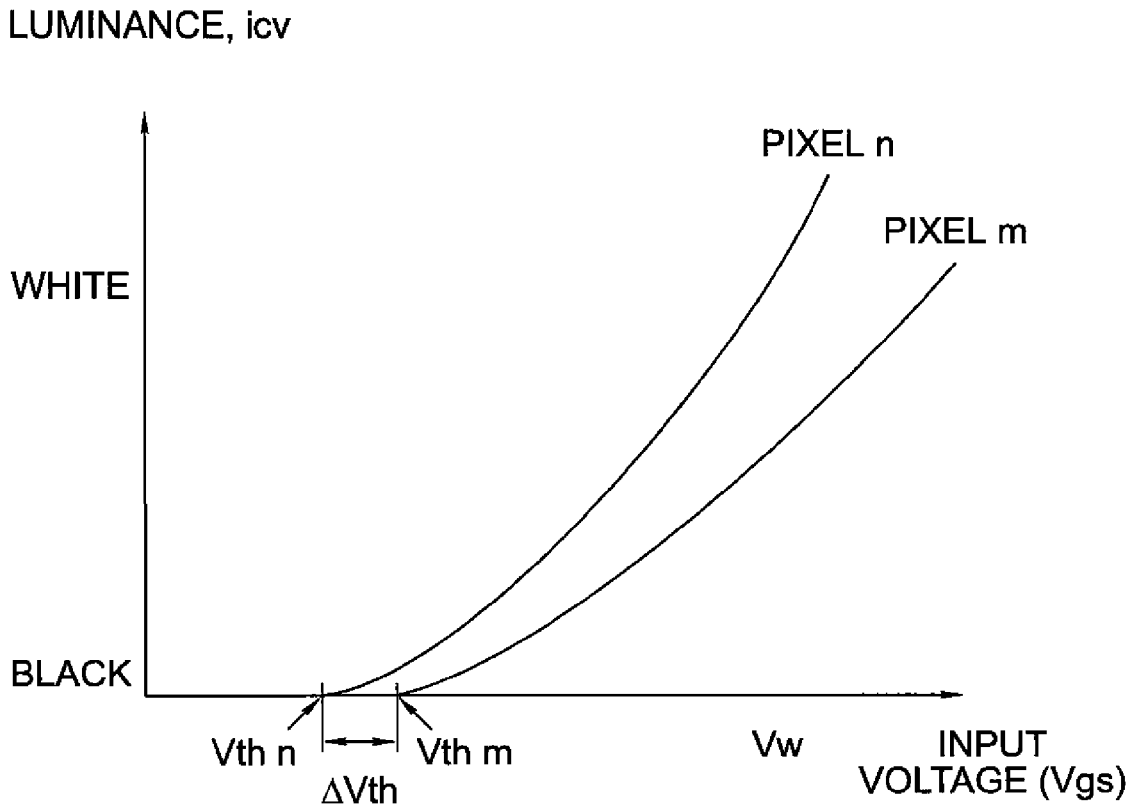
FIG. 3C is a graph showing a relationship between the input voltage, luminance, and driving current icv observed when variations occur in both the threshold voltage Vth and the inclination of the V-I characteristics.
Figure 4:
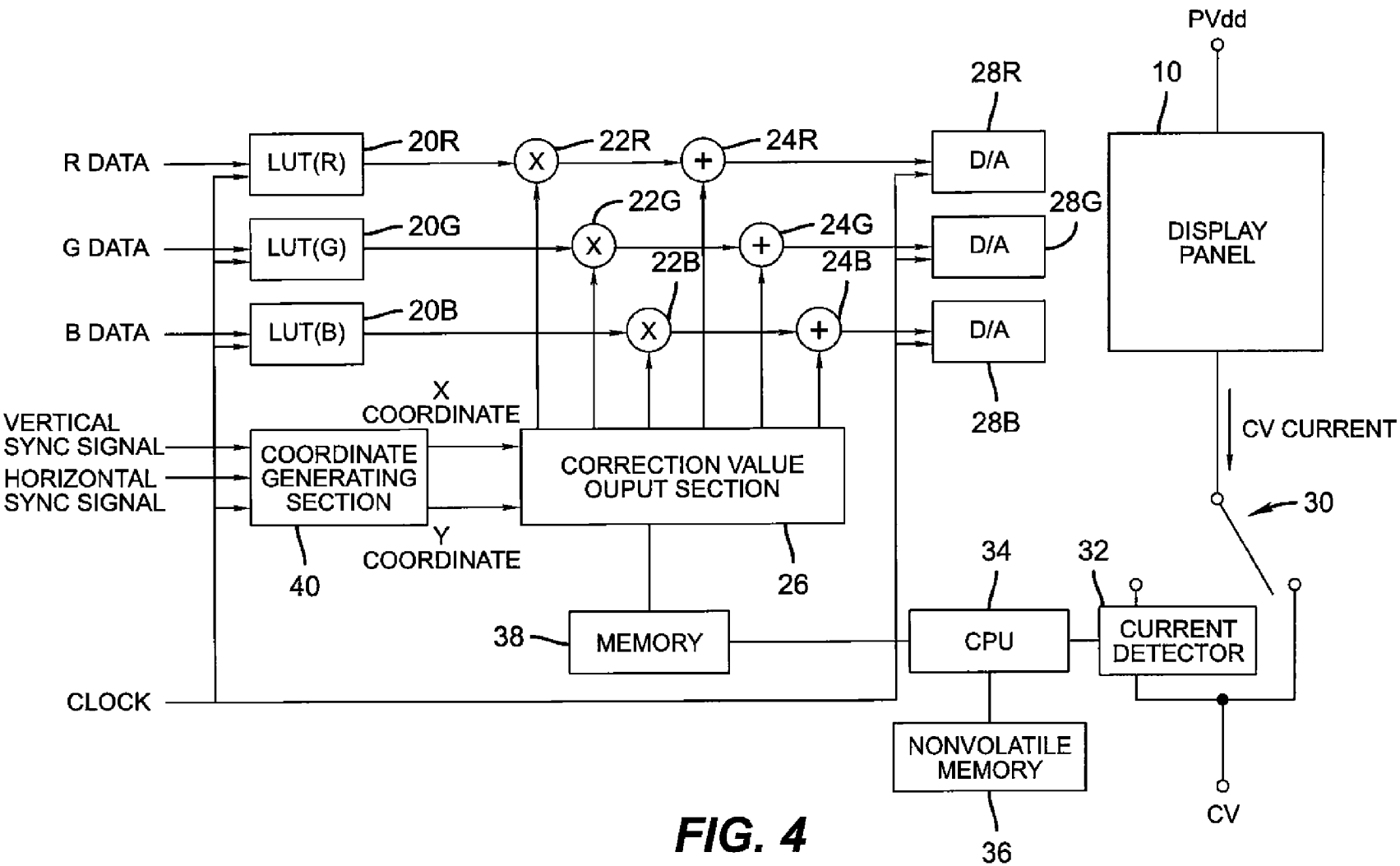
FIG. 4 is a block diagram showing a circuit arrangement for processing input data in accordance with a preferred embodiment of the present invention.

FIG. 4 shows the arrangement of an OLED display device in accordance with this embodiment, in which luminance data is input and corrected luminance data (i.e. analog signals) is output to be supplied to a display panel 10.

The display panel 10 has numerous pixels for respective RGB colors. The input data (i.e. pixel data, luminance data), being a voltage signal determining the luminance of each pixel, is input for each of respective RGB colors. For example, pixels of the same color are aligned in the vertical direction. One of RGB data signals is supplied to each data line to realize display of the color. According to this example, each of the RGB data is an 8-bit luminance data. The display panel 10 has the resolution of 320 pixels in the horizontal direction and 240 lines in the vertical direction. One pixel consists of three dots of RGB colors respectively.

In the following description, a coordinate (x, y) generally represents the position of a display area of the pixel. The coordinate value x, representing the position in the horizontal direction, becomes larger when a target display area shifts to the right. The coordinate value y, representing the position in the vertical direction, increases when the target display area shifts downward. Accordingly, coordinate (1, 1) is assigned to the pixel positioned at the upper left corner of the display area. Coordinate (320, 240) is assigned to the pixel positioned at the lower right corner.

An R signal is supplied to a look-up table LUT 20R, a G signal is supplied to a look-up table LUT 20G, and a B signal is supplied to a look-up table LUT 20B. The look-up tables LUT 20R, LUT 20G, and LUT 20B store table data that are subjected beforehand to gamma correction so that the relationship between input data (i.e. luminance data) and emitted light luminance (i.e. driving current) changes along a desired curve. Furthermore, the average offset and gain of the display panel 10 are taken into consideration in determining the table data. Accordingly, converting the luminance data by utilizing these look-up tables LUT 20R, LUT 20G, and LUT 20B enables the organic EL elements to emit light corresponding to the entered luminance data when the driving TFT has average characteristics. However, instead of using these look-up tables LUT 20R, LUT 20G, and LUT 20B, it is possible to store the mathematical formula of characteristics to convert the luminance data based on calculation.

A clock signal, synchronized with pixel data, is supplied to respective look-up tables LUT 20R, LUT 20G, and LUT 20B. Each of the look-up tables LUT 20R, LUT 20G, and LUT 20B produces an output in synchronism with this clock.

Multipliers 22R, 22G, and 22B, respectively disposed next to corresponding look-up tables LUT 20R, LUT 20G, and LUT 20B, receive output signals of these look-up tables respectively. A correction value output section 26 supplies, to these multipliers 22R, 22G, and 22B, correction values for correcting differences in the inclination of the V-I characteristics for respective pixels.

Adders 24R, 24G, and 24B, respectively disposed next to corresponding multipliers 22R, 22G, and 22B, receive output signals of these multipliers. The correction value output section 26 supplies, to these adders 24R, 24G, and 24B, correction values for correcting differences in the threshold voltage Vth of respective pixels.

D/A converters 28R, 28G, and 28B, respectively disposed next to corresponding adders 24R, 24G, and 24B, receive output signals of these adders and convert them into analog data signals. The display panel 10 has input terminals of respective colors to receive the analog data signals supplied from the D/A converters 28R, 28G, and 28B. Thus, the data signal, being corrected for each color as well as for each pixel, is supplied to the data line Data. In each pixel, the driving current corresponding to the data signal flows in the EL element.

The display panel 10 has a positive terminal connected to the power source PVdd and a negative terminal connected via a switch 30 to a constant voltage power source CV, directly or via a current detector 32. The switch 30 is provided to select the electrical path of the display panel 10 between the constant voltage power source CV and the current detector 32. In normal operations, the switch 30 directly connects a negative terminal of the display panel 10 to the constant voltage power source CV. Meanwhile, the switch 30 permits an operator or an automated checker, for example, in a factory to calculate correction data by using the current detector 32.

When the display panel 10 is connected via the switch 30 to the current detector 32, the current detector 32 supplies a detected current value, as digital data, to a CPU 34. The CPU 34 is associated with a nonvolatile memory 36, such as a flash memory or an EEPROM, that stores correction data for display pixels (or dots) that require correction.

A memory 38, connected to the CPU 34, can receive the data stored in the nonvolatile memory 36 via CPU 34. The memory 38 can, for example, be a RAM.

In the present embodiment, the CPU 34 is a microcomputer having the capability of controlling various operations of the OLED display device. In response to the turning on of the power source of the OLED display device, the CPU 34 writes into the memory 38 the above-described correction data stored in the nonvolatile memory 36.

The memory 38, connected to the correction value output section 26, supplies the data required for the correction value output section 26 to supply correction values to the multipliers 22R, 22G, and 22B and to the adders 24R, 24G, and 24B.

A coordinate generating section 40, also connected to the correction value output section 26, receives a vertical sync signal, a horizontal sync signal, and a clock signal synchronized with the pixel data, respectively. The coordinate generating section 40 generates coordinate signals in synchronism with the input data (i.e. pixel data). The generated coordinate signals are supplied to the correction value output section 26.

The correction value output section 26, in accordance with the pixel position of input data supplied from the coordinate generating section 40, reads correction data (i.e. for both of the inclination of the V-I characteristics and the shift of threshold voltage Vth) from the memory 38. Then, the correction value output section 26 supplies the readout correction data to the multipliers 22R, 22G, and 22B and to the adders 24R, 24G, and 24B, respectively. Accordingly, the multipliers 22R, 22G, and 22B and the adders 24R, 24G, and 24B can perform correction based on the correction data. The corrected RGB pixel data are then supplied to the D/A converters 28R, 28G, and 28B, respectively.

In this manner, this embodiment can correct any luminance nonuniformity, even any nonuniformity created during the manufacturing stage of the OLED display elements.

The switch 30 and the current detector 32 can be incorporated in the display device, so that the processing for calculating correction values can be done anytime. Hence, it is desirable to not only calculate correction values before shipment to store the data in the nonvolatile memory 36 but also execute such calculation of correction values at appropriate later timing, for example, when the number of power-on (or -off) operations of the display device reaches a predetermined number or when the cumulative operation time reaches a predetermined time. Such calculation should be done at the time the power source is turned on or off without interrupting other operations of the device. This is effective to eliminate any aging effects in the nonuniformity of display. Furthermore, it is preferable to provide a luminance adjusting button, so that the processing for calculating correction values can be manually started by pushing this button. Furthermore, when the storage of correction values is carried out only one time before shipment, the switch 30 and the current detector 32 are unnecessary.

Detection of Nonuniformity

Hereinafter, detection of correction data performed based on current values detected by the current detector 32 will be explained.

According to this embodiment, the display area is divided into a plurality of dissected areas (hereinafter, referred to as detection areas). The current detector 32 detects the driving current of a target detection area flowing in response to turning on of a corresponding OLED element. When the detected driving current value is different from that of other detection area, this area is identified as a detection area that requires correction.

i) Extraction of an Area Having Nonuniformity

Measurement of current is performed by sequentially changing the detection area to be actuated as shown in FIGS. 5A to 5F. For this measurement, the entire display area is divided into a plurality of large dissected areas, each having a predetermined size equivalent to 8 pixels in the horizontal direction and 8 lines in the vertical direction. During measurement, a constant level of activation signal (i.e. pixel data) is applied to the OLED element of the target detection area.

Figure 5A:
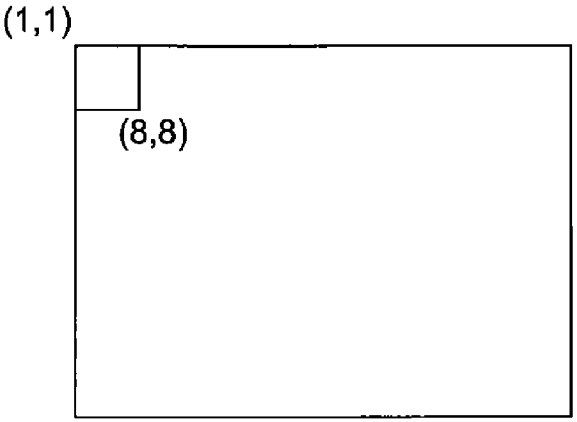
FIGS. 5A to 5F are diagrams showing a method for selecting target areas.
Figure 5B:
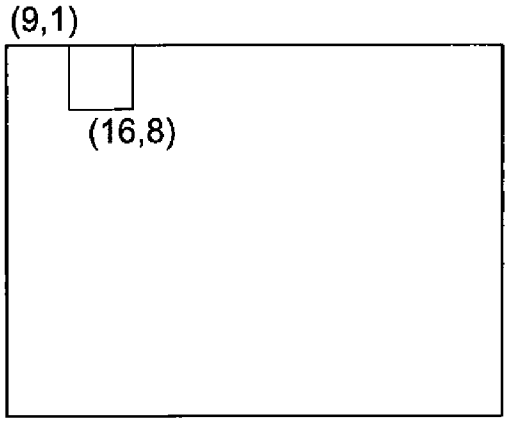
Figure 5C:
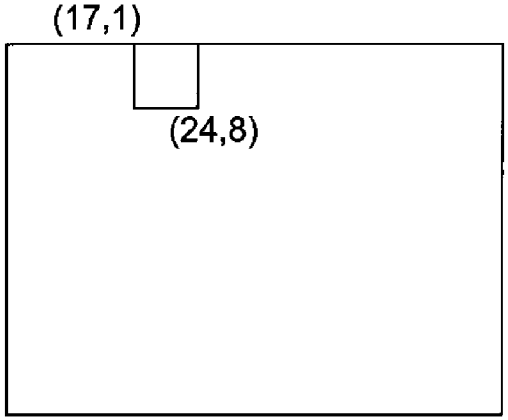
Figure 5D:
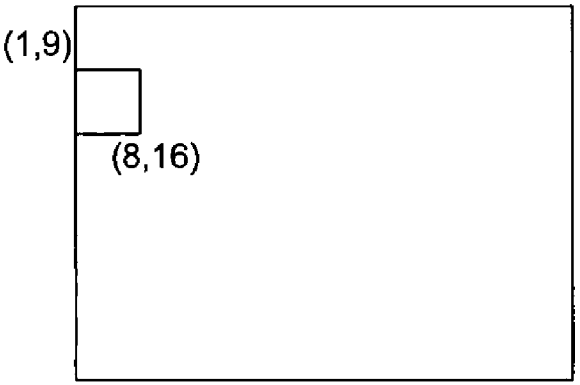
Figure 5E:
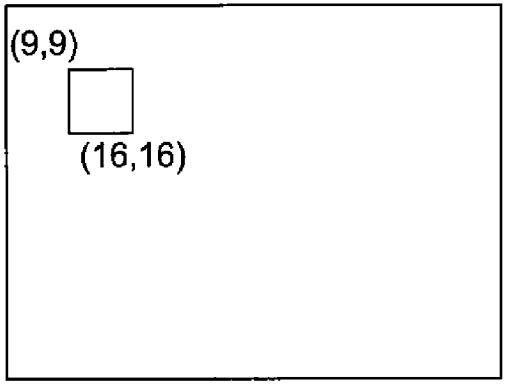
Figure 5F:
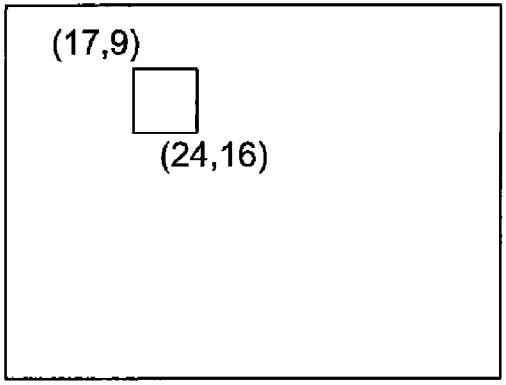

First, a large dissected area positioned at the upper left corner of the display area is activated as a detection area to be measured (refer to FIG. 5A). This detection area is a rectangular area that includes a pixel having coordinate value (1, 1) positioned at its upper left corner and a pixel having coordinate value (8, 8) positioned at its lower right corner. The current of this area is measured.

Next, the target detection area shifts to the right by the distance equal to 8 pixels. Namely, a rectangular area that includes an upper left pixel having coordinate value (9, 1) and a lower right pixel having coordinate value (16, 8) is activated to measure the current value (refer to FIG. 5B).

Similarly, the target detection area successively shifts to the right in increments of 8 pixels to measure current values of respective detection areas. When the measurement of current is completed at a rectangular area that includes an upper left pixel having coordinate value (313, 1) and a lower right pixel having coordinate value (320, 8), the target detection area shifts downward by a distance equal to 8 lines, where the current is similarly measured (refer to FIGS. 5D, 5E, and 5F). This measurement is repeatedly performed until a large dissected area positioned at the lower right corner of the display area, i.e. a rectangular area that includes an upper left pixel having coordinate value (313, 233) and a lower right pixel having coordinate value (320, 240), is activated as a final target detection area to measure the current value. The total number of measurements required for this current detection is 1200, being the product of 40 measurements in the horizontal direction and 30 measurements in the vertical direction.

Next, based on measured results, an area having a current value different from that of other majority of areas is extracted. In this case, as a method for extracting the area, it is possible to obtain an average of measurement results and set upper and lower threshold levels about the obtained average value. Then, the current of each detection area is compared with these threshold levels. When the current of a certain detection area is larger than the upper threshold level or smaller than the lower threshold level, this detection area is extracted as an area that requires correction. The extracted detection area includes a pixel that requires correction.

However, such a method may result in errors in the judgment if the luminance continuously changes along the entire display area, because luminance differences between individual pixels are relatively small compared with an entire change. Hence, in the present embodiment the following method is used to improves the S/N (i.e. signal to noise) ratio without greatly increasing the number of measurements, and accordingly eliminate the drawbacks described above. As a result, accurate extraction of areas having different current values is realized.

As shown in FIGS. 6A to 6F, each large dissected area has 16 pixels in the horizontal direction and 16 lines in the vertical direction. The measurement of current is performed by activating respective detection areas in the following order, with a constant level of signal given to each area.

Figure 6A:
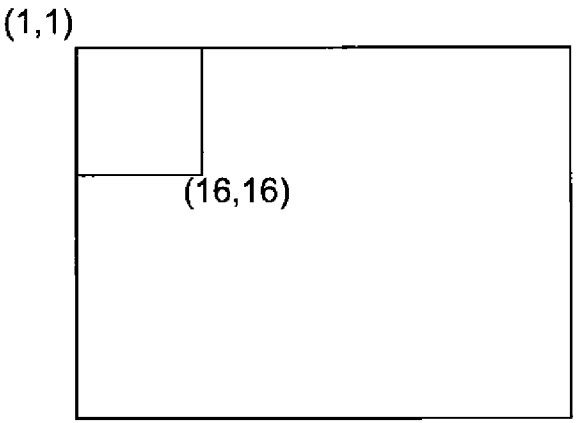
FIGS. 6A to 6F are diagrams showing a method for selecting target areas.
Figure 6B:
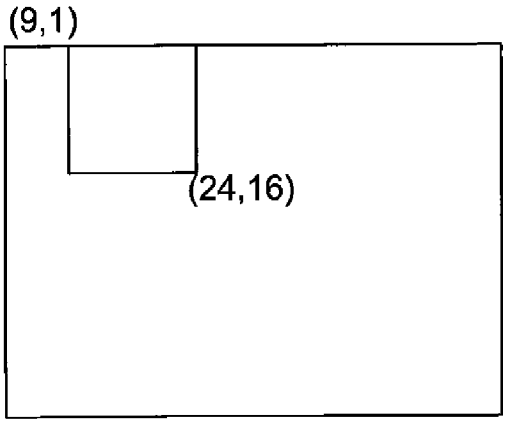
Figure 6C:
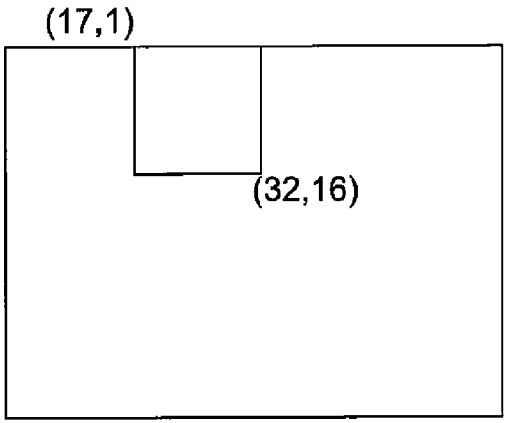

First, a large dissected area positioned at the upper left corner of the display area, i.e. a rectangular area that includes an upper left pixel having coordinate value (1, 1) and a lower right pixel having coordinate value (16, 16), is activated as a detection area to be measured (refer to FIG. 6A). The current of this area is measured.

Next, the target detection area shifts to the right by the distance equal to 8 pixels. Namely, a rectangular area that includes an upper left pixel having coordinate value (9, 1) and a lower right pixel having coordinate value (24, 16) is activated to measure the current value (refer to FIG. 6B).

Similarly, the target detection area successively shifts to the right in increments of 8 pixels to measure current values of respective detection areas. When the measurement of current is accomplished at a rectangular area that includes an upper left pixel having coordinate value (305, 1) and a lower right pixel having coordinate value (320, 16), the target detection area shifts downward by the distance equal to 8 lines. Then, the similar measurement is carried out.

Figure 6D:
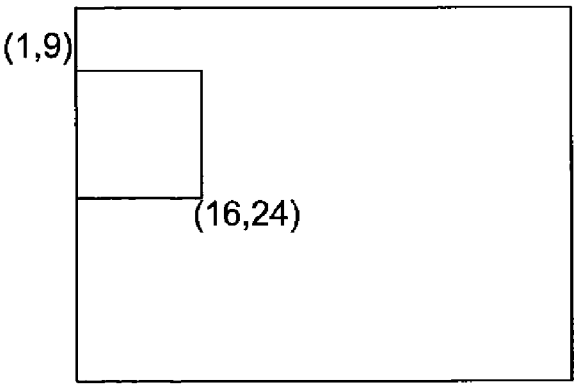
Figure 6E:
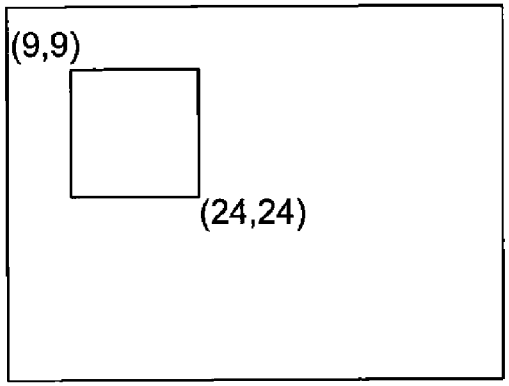
Figure 6F:
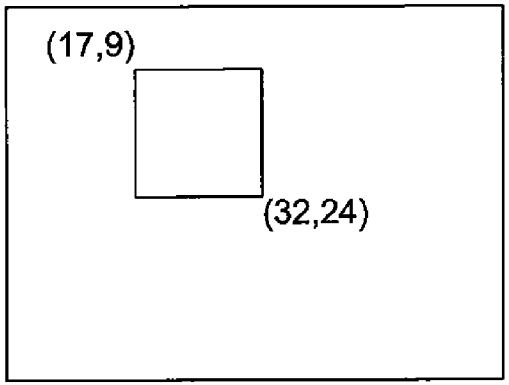

More specifically, a rectangular area that includes an upper left pixel having coordinate value (1, 9) and a lower right pixel having coordinate value (16, 24) is activated to measure the current value (refer to FIG. 6D).

Next, the target detection area shifts to the right by the distance equal to 8 pixels. Namely, a rectangular area that includes an upper left pixel having coordinate value (9, 9) and a lower right pixel having coordinate value (24, 24) is activated to measure the current value (refer to FIG. 6E).

Similarly, the target detection area successively shifts to the right in increments of 8 pixels to measure current values of respective detection areas. When the measurement of current is accomplished at a rectangular area that includes an upper left pixel having coordinate value (305, 9) and a lower right pixel having coordinate value (320, 24), the target detection area shifts downward by the distance of 8 lines. Then, the similar measurement is carried out.

This measurement is repeatedly performed until a large dissected area positioned at the lower right corner of the display area, i.e. a rectangular area that includes an upper left pixel having coordinate value (305, 225) and a lower right pixel having coordinate value (320, 240), is activated as a final target detection area to measure the current value. At this point, the number of measurements required for this current detection totals 1131.

Next, these measurement results are used to obtain the current value of each rectangular 8×8 pixel area having been subjected to noise reduction.

First, the entire display area is divided into a plurality of areas each having the size of 8×8 pixels (8 rows and 8 lines). Hereinafter, the expression [x, y] generally represents the position of a divided area, in which x stands for an x-th area from the left edge and y stands for a y-th area from the upper edge. More specifically, the area represented by [x, y] has an upper left corner having coordinate value (8x−7, 8y−7) and a lower right corner having coordinate value (8x, 8y).

Figure 7A:
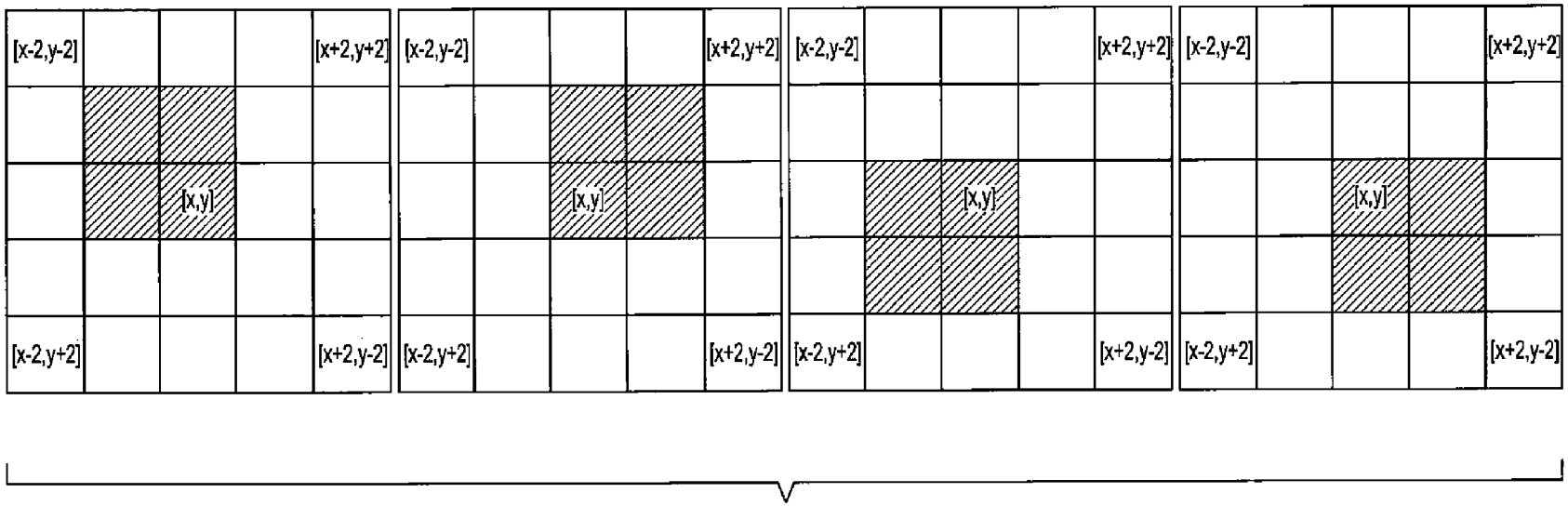
FIGS. 7A and 7B are diagrams showing a method for selecting target areas.
Figure 7B:
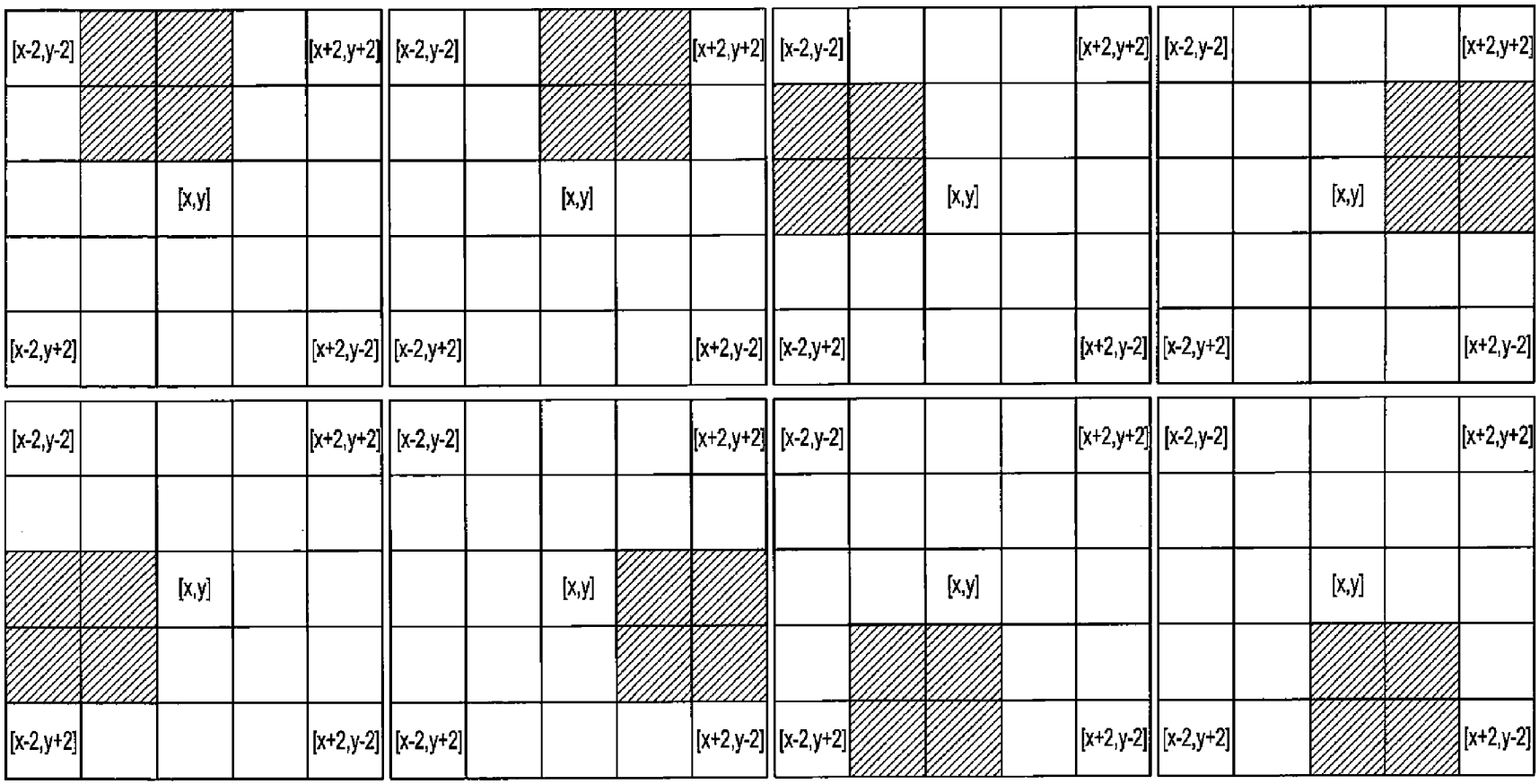

Next, a target 8×8 pixel area [x, y] is designated. Then, as shown in FIG. 7A, the measurement results are added with respect to four different dissected 16×16 pixel areas each including this target area. Furthermore, as shown in FIG. 7B, a sum of measurement results is obtained in eight different dissected 16×16 pixel areas each having a side adjoining the target area. The summed-up result is divided by 2. FIG. 7C shows the number of additions carried out through the above calculations, in each of the target 8×8 pixel area and peripheral 8×8 pixel areas surrounding this target area. The measurement result of the target area [x, y] is added four times. The measurement result of the area having a side adjoining the target area, i.e. each of the areas [x, y−1], [x−1, y], [x+1, y], and [x, y+1], is added only once.

The area having a corner point being in contact with that of the target area [x, y], i.e. each of the areas [x−1, y−1], [x+1, y−1], [x−1, y+1], and [x+1, y+1]), has the same weighting factor in addition and in subtraction of measurement results.

The measurement result in each of the areas [x, y−2], [x−2, y], [x+2, y], and [x, y+2] is subtracted one time. The measurement result in each of the areas [x−1, y−2], [x+1, y−2], [x−2, y−1], [x+2, y−1], [x−2, y+1], [x+2, y+1], [x−1, y+2], and [x+1, y+2] is subtracted ½ time. As a result, a filter coefficient shown in FIG. 7C is obtained as an evaluation value for the nonuniformity of the target area [x, y]. This evaluation value, i.e. the result of calculations, takes 0 when the current values of respective areas are identical. On the other hand, when an absolute value of this evaluation value exceeds a predetermined threshold value, it can be concluded that this target area includes a nonuniformity.

According to this method, judgment errors decrease even when the luminance continuously changes along the entire display area.

According to this method, the above filter processing requires the data of two additional lines existing just outside the outer periphery of the screen. To solve this problem, it is preferable to use dummy data in calculation for the additional areas surrounding the screen.

Figure 9A:
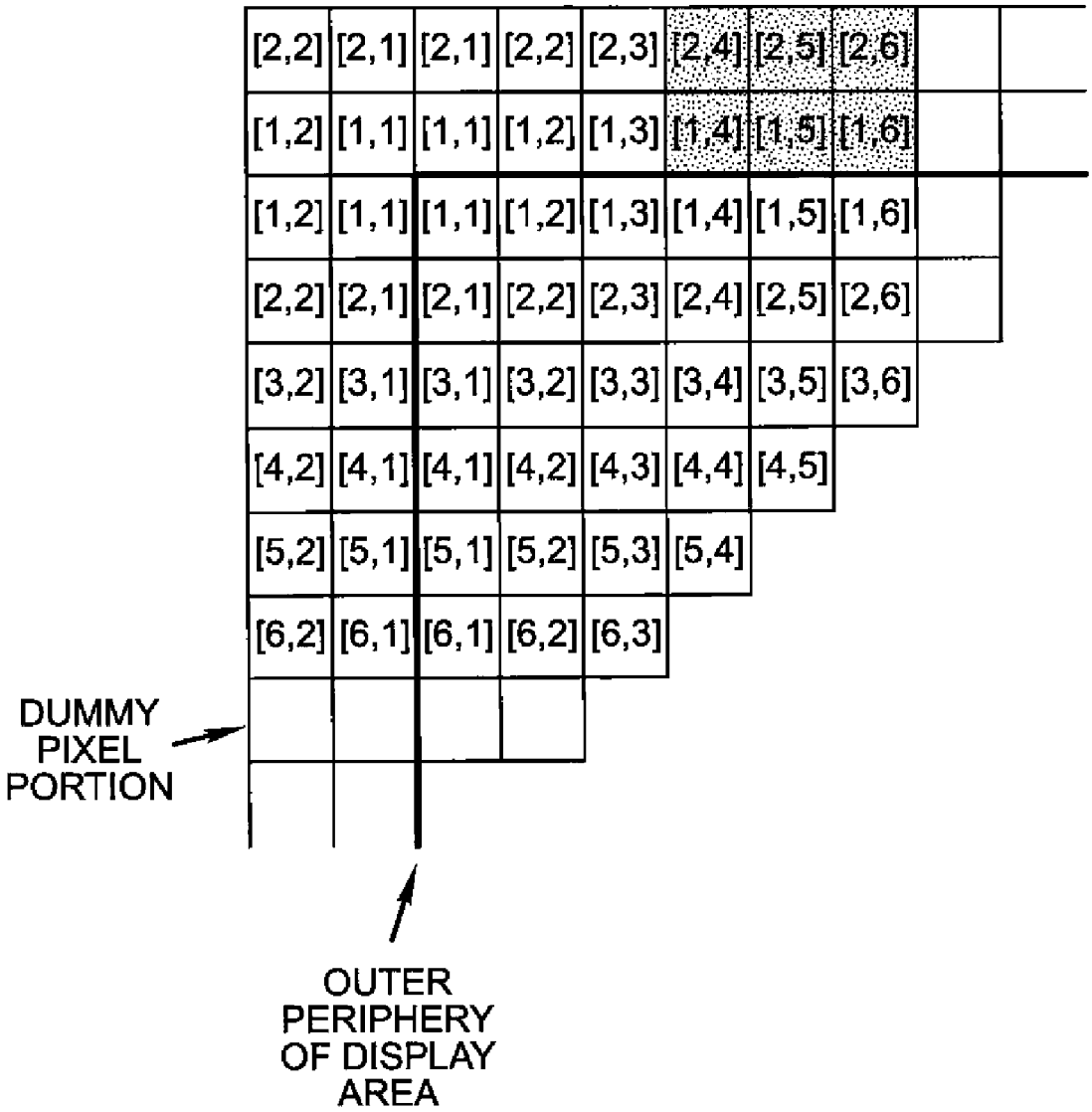
FIGS. 9A and 9B are diagrams showing a method for processing peripheral areas.
Figure 9B:
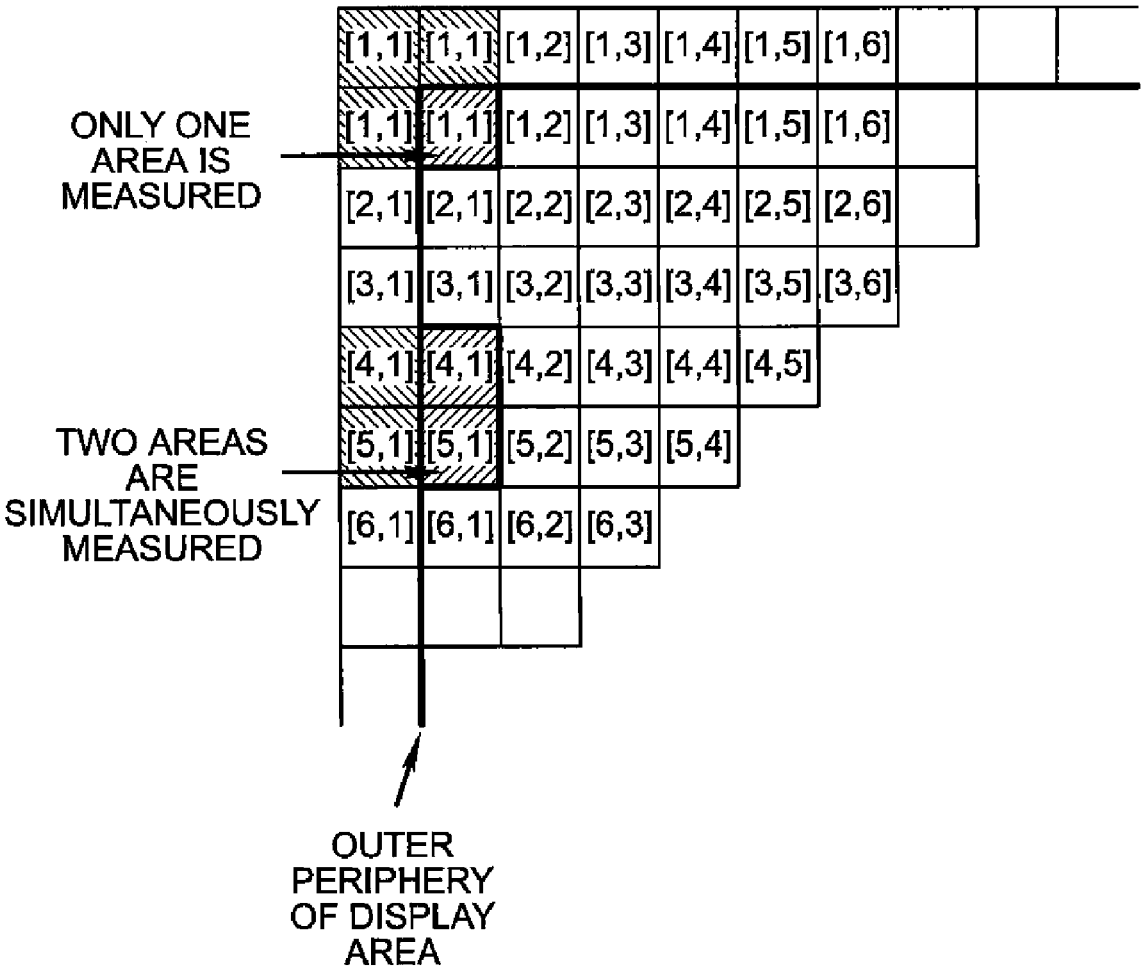

FIG. 9A shows an example of such dummy data. This example requires a total of 140 additional measurements. The data of 16×16 pixel areas, provided as dummy portion, have the same values measured in the screen. For the data of 16×16 pixel areas straddling the outer periphery of the display region, the measurement shown in FIG. 9B is added. In this manner, utilizing the dummy data of the dummy portion, which does not physically exist, makes it possible to perform the processing for the areas positioned along the periphery of the display area in the same manner as in other areas. More specifically, one 8×8 pixel area positioned inside a corner of the screen is measured independently and the measurement result is multiplied by 4 to regard it as the measured data of the 16×16 pixel area positioned at this corner of the screen. Meanwhile, two consecutive 8×8 pixel areas positioned along a side of the screen are measured together and the measurement result is multiplied by 2 to regard it as the measurement data of a 16×16 pixel area positioned along this side of the screen.

Figure 10:
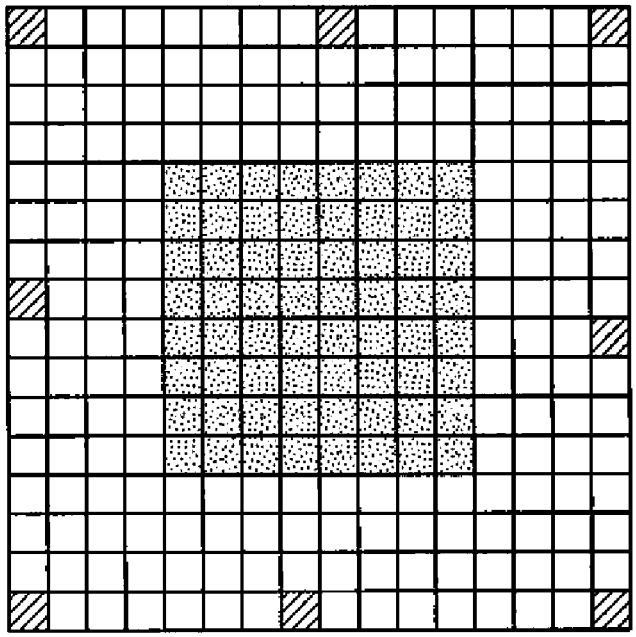
FIG. 10 is a diagram showing a method for calculating correction values in an area.
Figure 11:
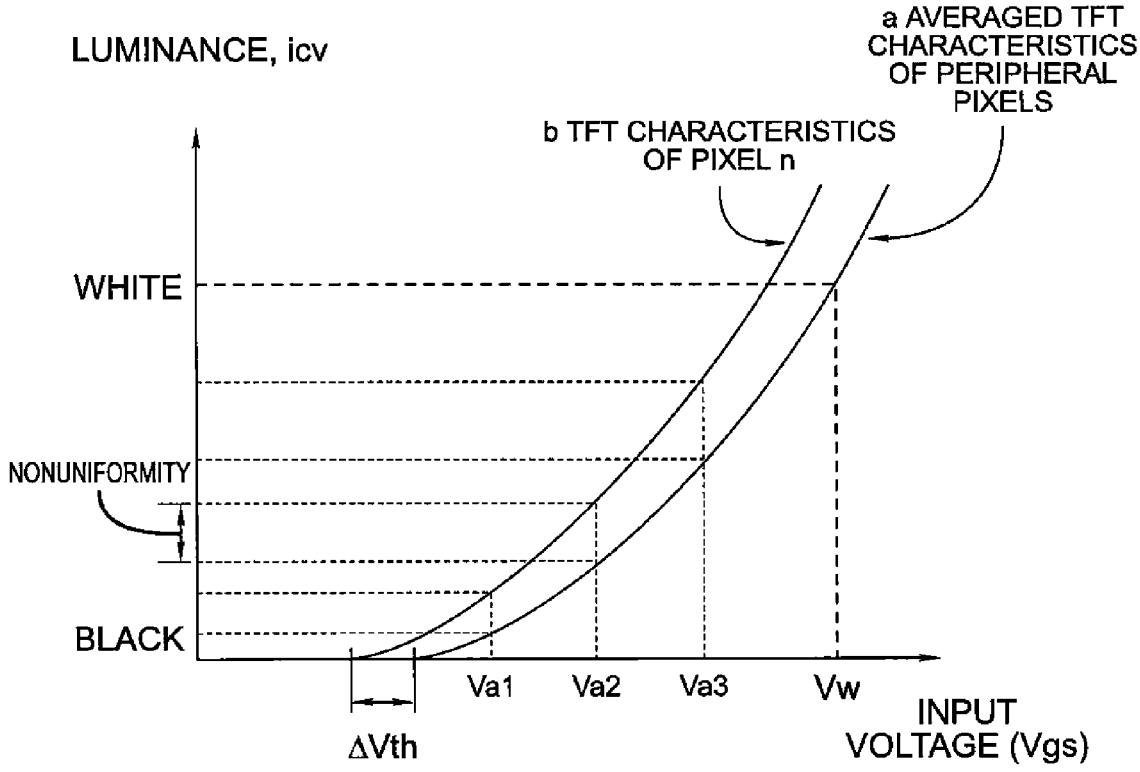
FIG. 11 is a graph showing the difference in the V-I characteristics.
Figure 12:
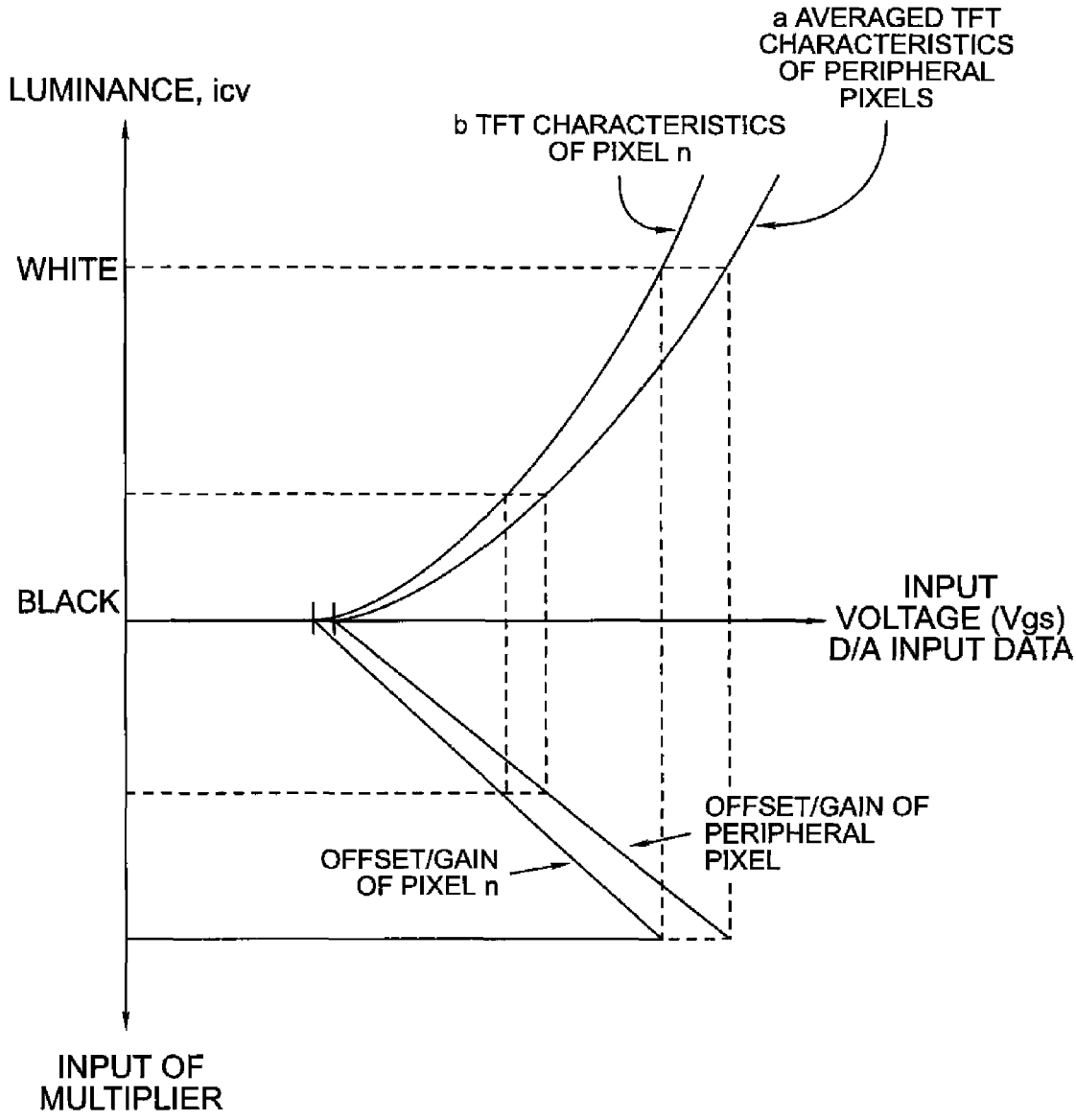
FIG. 12 is a graph explaining calculation of correction values.

According to this method, compared with a method of using a similar filter calculated based on measured current values of individual 8×8 pixel areas, the obtained data have better S/N ratios. The number of measurements according to this method, even if the processing for the added outer peripheral portion is included, is comparable with that of the method for measuring current values of individual 8×8 pixel areas. More specifically, this method requires 1271 measurements, which is slightly larger than 1200 times of the above comparable method. The S/N ratio is substantially identical with an average value of four measurements.

ii) Calculation of Correction Values a) As shown in FIG. 10, a 16×16 pixel area is set so that the 8×8 pixel area having the nonuniformity is positioned at the center thereof. Then, as shown in the drawing, a total of eight pixels located at predetermined discrete positions along the outer periphery of this 16×16 pixel area are simultaneously activated at two or more input voltage levels (e.g., Va1, Va2, and Va3 shown in FIG. 11 in this example) to measure the CV current value at each input voltage. The average current (icv) of each pixel is obtained by dividing the CV current by 8. Thus, the relationship of the input voltage and icv can be plotted based on the obtained data. From these results, an average V-I characteristics of TFTs in the peripheral areas can be predicted and plotted (refer to a line (a) of FIG. 12).

b) Only one pixel in the 8×8 pixel area, which is judged as having nonuniformity, is activated at least at two input voltage levels (e.g. three points of Va1, Va2, and Va3 according to this embodiment) to measure the CV current value at each input voltage. From these results, the V-I characteristics of a TFT of this pixel can be predicted and plotted (refer to a line (b) of FIG. 12). Similarly, the V-I characteristics of TFTs of all pixels in this area can be predicted and plotted.

c) By using FIG. 11, a deviation of the pixel n relative to its peripheral pixels is obtained in the threshold voltage Vth as well as in the inclination (gm) of the V-I curve. Then, a gain correction value and an offset are obtained with reference to the characteristics of peripheral pixels, so that differences in the corresponding CV current or in the luminance can be minimized (refer to FIG. 12).

The gain is a value supplied to the multiplier 22. The offset is a value supplied to the adder 24. The nonvolatile memory 36 stores gain and offset values having been subjected to correction or their correction values, and coordinate values of pixels. The corrected gain and offset values are multiplied with or added to corresponding pixel data.

Variations and Applications

Figure 8A:
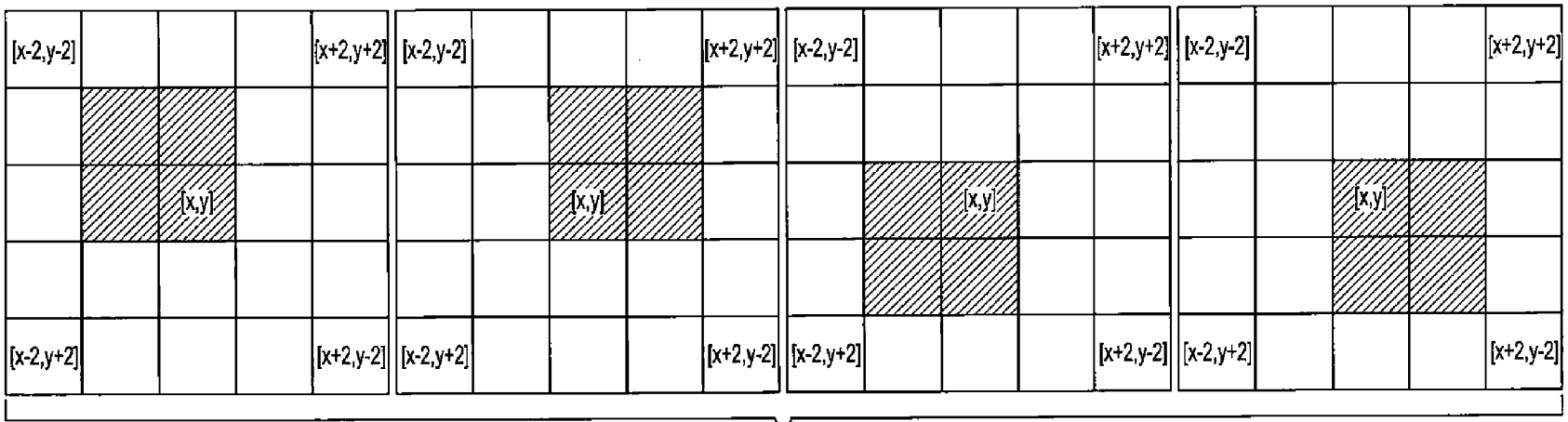
FIGS. 8A and 8B are diagrams showing a method for selecting target areas.
Figure 8B:
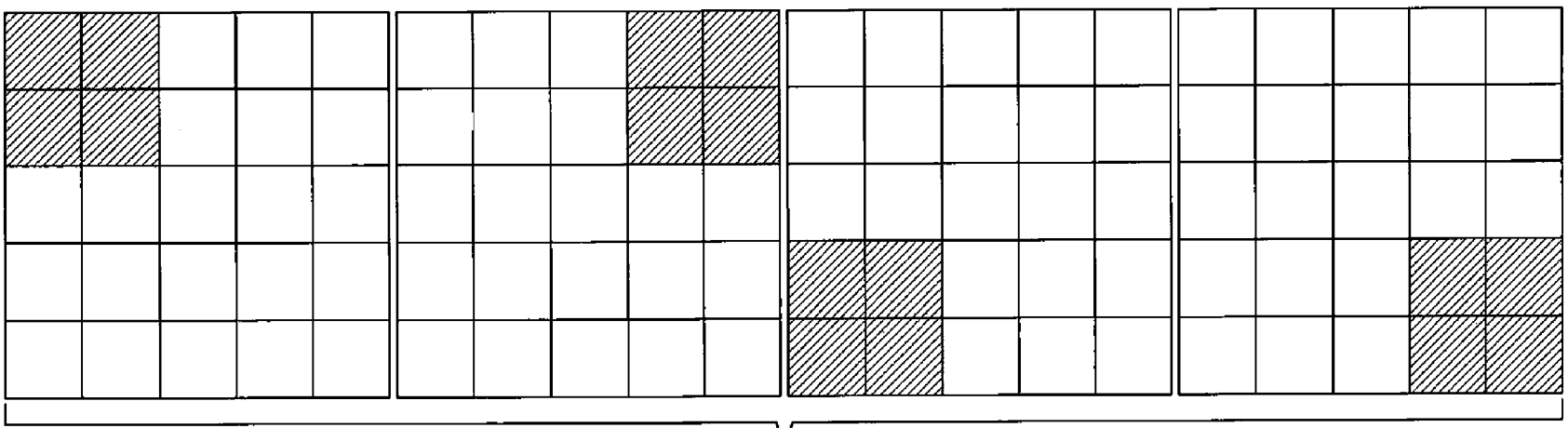

FIGS. 8A to 8C explain another example for obtaining the filter coefficients. According to this example, from summed values of respective pixels in the areas shown in FIG. 8A are subtracted summed values of respective pixels in the areas shown in FIG. 8B to obtain filter coefficients of FIG. 8C.

Accordingly, by applying this filter to the detected current values in respective detection areas, it becomes possible to determine the current value in each area.

In the above explanation, an area of 8×8 pixels is considered when judging the necessity of correction. However, the size of this area can be increased or decreased as determined to be appropriate. Furthermore, it is possible to apply hierarchical dividing processing to the display area by using large dissected areas, medium dissected areas, and small dissected areas. First, a large dissected area that requires correction is identified. Then, with respect to the identified large dissected area, a medium dissected area that requires correction is identified. Similarly, with respect to the identified medium dissected area, a small dissected area that requires correction is identified. Finally, with respect to the identified small dissected area, the correction value of a pixel that requires correction can be obtained. For example, the detection is first performed by using the size of a 32×32 pixel area. Then, in a 32×32 pixel area identified as a correction object, similar processing can be performed by reducing the size of detection area to an 8×8 pixel area and then to a single pixel. Especially, it is preferable to select one display pixel or one dot as an objective area to be finally processed and cause each pixel or dot to emit light to detect a driving current.

While the present invention has been described with reference to exemplary embodiments, it is to be understood that the invention is not limited to the disclosed examples. The scope of the following claims is to be accorded the broadest interpretation so as to encompass all modifications, equivalent structures and functions.

PARTS LIST

1 thin film transistor
1, 1 coordinate value
1, 9 coordinate value
2 n-channel TFT
3 OLED element
8, 8 coordinate value
9, 1 coordinate value
9, 9 coordinate value
10 display panel
16, 8 coordinate value
16, 16 coordinate value
16, 24 coordinate value
20B LUT
20G LUT
20R LUT
22B multiplier
22G multiplier
22R multiplier
24B adder
24G adder
24R adder
24, 16 coordinate value
24, 24 coordinate value
26 value output section
28B D/A converter
28G D/A converter
28R D/A converter
30 switch
32 current detector
34 CPU
36 nonvolatile memory
38 memory
40 coordinate generating section
240 coordinate

305, 1 coordinate value
305, 225 coordinate value
305, 9 coordinate value
313, 1 coordinate value
313, 323 coordinate value
320 coordinate
320, 4 coordinate value
320, 8 coordinate value
320, 16 coordinate value
320, 240 coordinate value

The invention claimed is:

1. A method for generating correction data for pixels in an organic LED display device including a plurality of the pixels in a matrix pattern, each pixel including an organic LED dement, comprising:

a) dividing a display area into a plurality of predetermined detection areas to selectively cause organic LED elements of a plurality of pixels in the detection areas to emit light to detect a driving current for each detection area;

b) detecting, based on driving current values detected for respective detection areas, a detection area that includes a plurality of pixels, has a luminance value different from that of other detection areas and requires correction;

c) calculating correction data required for correcting image data for each pixel in the detection area that requires correction, the calculation including:

i) selecting a pixel area that is positioned around the detection area;

ii) simultaneously activating a plurality of selected periphery pixels of the pixel area at a first input voltage level, and at a second voltage level, and measuring corresponding currents for each voltage level, to provide an average V-I characteristic of the pixel area, wherein the selected periphery pixels are outside the detection area;

iii) while no other pixels are active, sequentially activating each pixel in the detection area at a third input voltage level and at a fourth input voltage level and measuring corresponding currents for each voltage level to provide a respective V-I characteristic of each pixel in the detection area; and iv) calculating, for each pixel in the detection area, correction data including a gain correction value and an offset of the V-I characteristic of the pixel with reference to the average V-I characteristic; and d) storing, in a memory, the correction data calculated for each pixel in the detection area.

2. The method of claim 1, further comprising:

subdividing the detection area that requires correction into a plurality of smaller detection areas;

performing, one time or sequentially at least two times on the smaller detection areas, the processing for detecting a smaller detection area that requires correction; and obtaining an objective detection area as an object that requires calculation of correction data.

3. The method of claim 2, wherein the objective detection area, obtained as the object that requires calculation of correction data, is one pixel or one dot in a display.

4. The method of claim 1, further comprising the steps of:

processing, with respect to current values detected from the divided detection areas of the display area, a plurality of predetermined detection areas including an objective detection area by multiplying a two-dimensional space filter with the detect currents;

detecting an objective detection area that requires correction based on the result of the processing; and wherein the two-dimensional space filter has coefficients of respective detection areas selected to add a value of a peripheral detection area positioned closely to the objective detection area, and subtract a value of a peripheral detection area positioned far from the objective detection area.

5. The method-of claim 4, wherein:

detection of the driving current in each detection area is performed by sequentially changing a target position and simultaneously activating a plurality of detection areas;

the two-dimensional space filter is calculated based on the detected results.

6. The method of claim 4, wherein the two-dimensional space filter has coefficients of respective detection areas, thereby giving a large weighting factor to the objective detection area, adding a value of a peripheral detection area positioned closely to the objective detection area, and subtracting a value of a peripheral detection area positioned far from the objective detection area.

7. The method of claim 1, wherein step c.ii, further includes activating the plurality of selected periphery pixels of the pixel area at a fifth input voltage level to provide the average V-I characteristic of the pixel area.

8. The method of claim 7, wherein step c.iii, further includes activating each pixel in the detection area at a sixth input voltage level to provide the respective V-I characteristic of each pixel in the detection area.

9. The method of claim 8, wherein the first input voltage level equals the third input voltage level, the second input voltage level equals the fourth input voltage level, and the fifth input voltage level equals the sixth input voltage level.

10. The method of claim 1, wherein the detection area is positioned at the center of the pixel area.

11. The method of claim 1, wherein the correction data are calculated for fewer than all the pixels in the display.

* * * * *